US009911370B2

(12) United States Patent
Magness

(10) Patent No.: US 9,911,370 B2
(45) Date of Patent: Mar. 6, 2018

(54) FLAG PIN, FLAG PIN KIT, AND METHODS OF USING THE SAME

(71) Applicant: Sara Magness, Bel Air, MD (US)

(72) Inventor: Sara Magness, Bel Air, MD (US)

( * ) Notice: Subject to any disclaimer, the term of this patent is extended or adjusted under 35 U.S.C. 154(b) by 170 days.

(21) Appl. No.: 14/968,202

(22) Filed: Dec. 14, 2015

(65) Prior Publication Data

US 2017/0169739 A1 Jun. 15, 2017

(51) Int. Cl.

| | |
|---|---|
| ***B43M 15/00*** | (2006.01) |
| ***G09F 17/00*** | (2006.01) |
| ***A63F 3/04*** | (2006.01) |
| *A63F 3/00* | (2006.01) |

(52) U.S. Cl.

CPC ..... *G09F 17/00* (2013.01); *A63F 3/00697* (2013.01); *A63F 3/0434* (2013.01); *B43M 15/00* (2013.01); *A63F 2003/00864* (2013.01); *A63F 2003/0436* (2013.01); *G09F 2017/0066* (2013.01)

(58) Field of Classification Search

CPC ..... A63F 11/00; B43M 15/00; G09F 3/02; G09F 3/12; G09F 17/00; G09F 2017/0066

USPC .... 33/574, 577, 578, 579; 40/598, 620, 621, 40/622, 661.11; 116/173; 434/150, 153

See application file for complete search history.

(56) References Cited

U.S. PATENT DOCUMENTS

D4,565 S * 1/1871 Tifft ..... D11/180
1,686,512 A * 10/1928 Burkenstein ..... B25D 5/00 33/27.02
2,645,317 A * 7/1953 Staaf ..... F16B 9/026 40/620
4,520,985 A * 6/1985 Blumenthal ..... A63C 19/062 248/156
4,583,482 A * 4/1986 Smith ..... G09F 17/00 116/173
D389,868 S * 1/1998 Voorhees ..... D19/65
7,004,703 B2 * 2/2006 Johnson et al. ..... F16B 15/02 411/439
7,017,512 B2 * 3/2006 Laird et al. ..... G09F 17/00 116/173
7,788,835 B2 * 9/2010 Venn ..... G09F 7/22 40/440

(Continued)

FOREIGN PATENT DOCUMENTS

CN 201484020 U * 5/2010 ..... B43M 15/00
CN 201881785 U * 6/2011 ..... B43M 15/00
GB 2484322 A * 4/2012 ..... A63C 19/062

*Primary Examiner* — R. A. Smith
(74) *Attorney, Agent, or Firm* — Whiteford, Taylor & Preston, LLP; Gregory M. Stone

(57) ABSTRACT

A flag pin is provided comprising a pin, a flag at the end of the pin, a sleeve positioned around the pin, and a flexible base receiving the tip of the pin therethrough and abutting the bottom of the sleeve. A user may insert the flag pin into the sleeve so that the tip of the pin extends from the bottom of the sleeve, and move the bottom of the pin through the flexible base so that the top of the base rests against the bottom of the cylindrical sleeve. The bottom end of the pin may then extend into a base on which the pin is to be placed, with the flexible base vertically supporting the cylindrical sleeve and the pin itself, and holding the pin in a generally vertical orientation. A kit for assembling flag pins and a related method are also provided.

17 Claims, 3 Drawing Sheets

(56) References Cited

U.S. PATENT DOCUMENTS

| | | | | |
|---|---|---|---|---|
| 8,177,185 | B2 * | 5/2012 | Priegel | G09F 17/00 135/16 |
| D778,355 | S * | 2/2017 | Magness | D19/64 |
| 2008/0127881 | A1 * | 6/2008 | Stegmann et al. | A63B 57/357 116/173 |
| 2009/0013921 | A1 * | 1/2009 | Yun | G09F 17/00 116/173 |
| 2012/0256717 | A1 * | 10/2012 | Roche | B32B 3/06 335/302 |

* cited by examiner

FLAG PIN, FLAG PIN KIT, AND METHODS OF USING THE SAME

FIELD OF THE INVENTION

This invention relates generally to moveable markers, and more particularly to marker pin assemblies configured for easy and safe placement of a flag-mounting pin on a diagram, such as a map, game board or other base.

BACKGROUND OF THE INVENTION

Temporarily positionable markers are frequently used to direct an observer's view to a particular region or feature on a diagram. For example, a wide variety of games and teaching tools are available that utilize maps, whether for playing geography based games, for teaching geography lessons, for denoting remarkable places of interest, and for wide varieties of other purposes. Often times, users of such maps wish to temporarily mark notable locations, such as to note places of previous travel, to test geographical knowledge, and the like. Similarly, and by way of non-limiting example, markers can be used to note particular features or aspects of historical maps and events, can be used on timelines to note, for instance, dates of particular interest, and can be used on scientific diagrams (e.g., atomic models, DNA models, dissection models, microscope imaging, earth science diagrams, and other scientific diagrams generally). The uses of temporarily positionable markers are widely diverse, and many other applications beyond those listed here by way of example will be apparent to those skilled in the art.

Various markers have previously been provided for such purposes, including push pins. Push pins can provide an immediate reference to a particular spot of interest on the diagram, and are typically placed by simply pushing the pin into the diagram and any substrate on which the diagram is printed, such as a semi-rigid foam pad backing as is commonly used. However, while push pins may be provided in various shapes and colors, they do little to identify specific locations on the diagram, other than marking it as a spot of interest.

Flags have also been provided attached to pins for similar placement on a diagram surface. Such flags may be provided in various colors and with various indicia printed on the flag face to indicate specific items of interest, such as (by way of non-limiting example) a particular city, state, country, etc. on a map that the flag is identifying. While such assemblies are helpful in identifying specific regions of a diagram by name, traditional map flag assemblies typically comprise simply a straight pin with a flag attached to the top of the pin, and vertical positioning of the flag by pushing through the diagram surface can be quite difficult. Oftentimes, placement of such previously known pin flag assemblies results in flags being positioned at varying angles across the diagram surface, providing a non-uniform and, to some, unpleasant or sloppy appearance.

It would therefore be advantageous to provide a reconfigurable flag pin that may be placed on a diagram surface and held in a vertical position without requiring significant effort on the part of the user, such that a child using the flag pin would be able to easily and quickly position multiple flags across the diagram surface. It would also be advantageous to provide a flag pin that may be placed on a diagram surface while minimizing the risk of injury to a child.

SUMMARY OF THE INVENTION

Disclosed is a flag pin assembly that avoids the disadvantages of prior art flag pins. A flag pin is provided comprising a straight pin with a sharpened end, and a flag positioned at the opposite end of the pin. A vertical, cylindrical sleeve is positioned around the pin, and a flexible base is configured to receive the sharpened tip of the pin therethrough and to abut the bottom of the cylindrical sleeve. In use, a user inserts the flag pin into the cylindrical sleeve so that the sharpened tip of the pin extends out of the bottom of the sleeve, preferably punctures the flexible base with the sharpened tip of the pin, and moves the bottom of the pin into and through the flexible base so that the top of the flexible base comes to rest against the bottom of the cylindrical sleeve. In this configuration, the bottom end of the pin may then extend into the typically foam pad base of the map or other diagram surface on which the flag pin is to be used, with the flexible base vertically supporting both the cylindrical sleeve and the pin itself, and holding the pin in a generally vertical orientation. The cylindrical sleeve prevents the pin from bending, and likewise prevents a flag that is attached at the top of the pin from slipping down the pin when a user, such as a child, pushes on the flag. The flexible base (which may in certain embodiments be formed of silicone) holds both the cylindrical sleeve and the pin in a generally vertical orientation, such that the flag pin stands generally straight on the diagram. The flexible base also provides a sufficient base for the flag pin assembly so as to avoid the need of pushing the pin all of the way through the foam pad on which the map or other diagram is mounted.

In accordance with certain aspects of an embodiment of the invention, a flag pin is provided comprising a straight pin having a top end and a bottom end opposite the top end, a flag extending outward from the top end of the pin, a cylindrical sleeve having a channel extending through an entire length of the sleeve, the cylindrical sleeve being positioned below the flag, and a flexible base positioned below the sleeve, wherein the pin extends through both the cylindrical sleeve and the flexible base, and wherein the bottom end of the pin extends a distance away from a bottom of the flexible base.

In accordance with further aspects of an embodiment of the invention, a method of using a flag pin is provided, comprising: providing a straight pin having a top end and a bottom end opposite the top end, and a flag extending outward from the top end of the pin; providing a cylindrical sleeve having a channel extending through an entire length of the sleeve; providing a flexible base; positioning the cylindrical sleeve around the pin and below the flag; and positioning the flexible base around the pin and below the cylindrical sleeve, such that the pin extends through both the cylindrical sleeve and the flexible base, and such that the bottom end of the pin extends a distance away from a bottom of the flexible base.

In accordance with still further aspects of an embodiment of the invention, a flag pin kit is provided, comprising a plurality of straight pins, each having a top end and a bottom end opposite the top end, a flag extending outward from each top end of each of the pins, a plurality of cylindrical sleeves, each having a channel extending through an entire length of the sleeve sized to receive one of the pins therethrough, and a plurality of flexible bases configured for placement on each of the pins adjacent to one of the sleeves, wherein each of the flags, the sleeves, and the flexible bases are sized with respect to the pins so that any one of the pins will extend through any one of the cylindrical sleeves and any one of the flexible bases so that a bottom end of the pin will extend a distance away from a bottom of the flexible base when the cylindrical sleeve and the flexible base are positioned on one of the pins.

BRIEF DESCRIPTION OF THE DRAWINGS

The numerous advantages of the present invention may be better understood by those skilled in the art by reference to the accompanying drawings in which.

DETAILED DESCRIPTION

The invention summarized above may be better understood by referring to the following description, claims, and accompanying drawings. This description of an embodiment, set out below to enable one to practice an implementation of the invention, is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
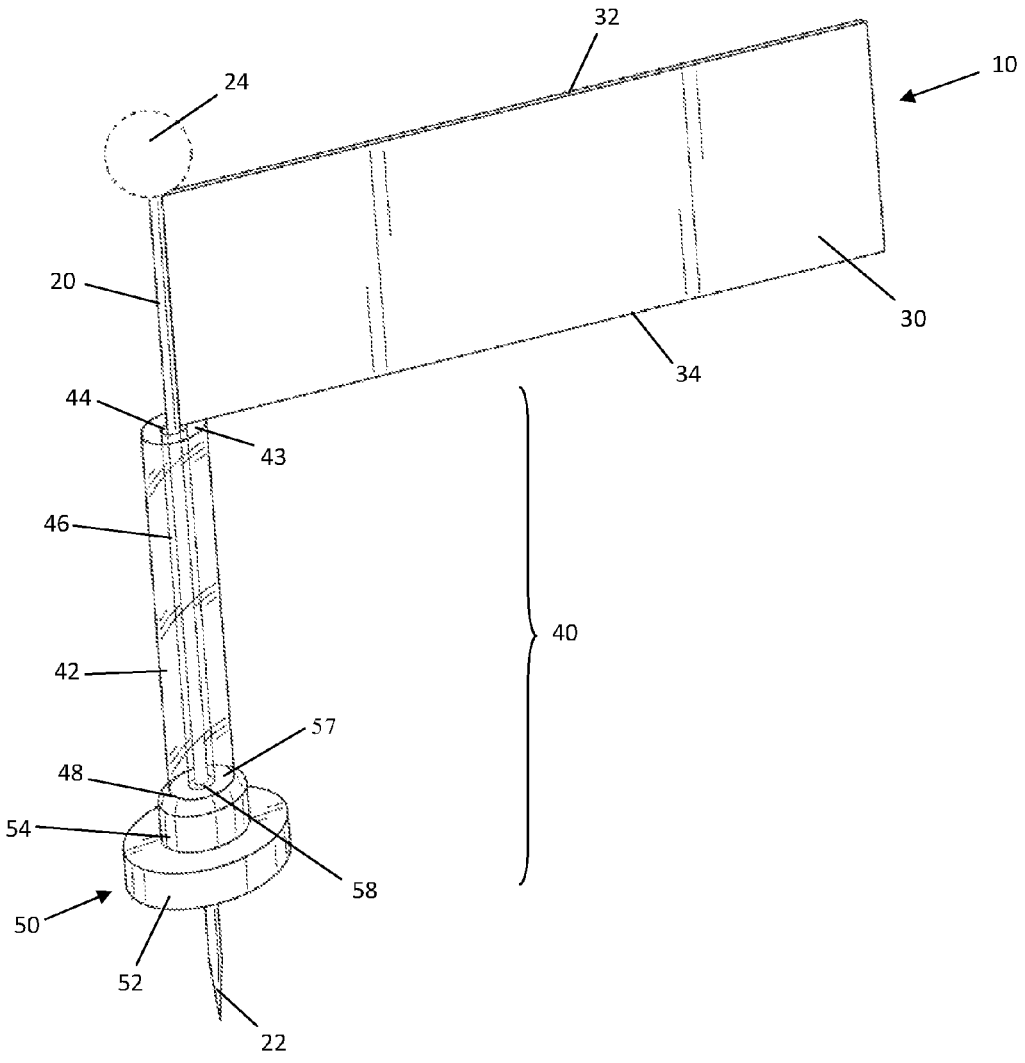
FIG. 1 is a perspective view of a flag pin in accordance with certain aspects of an embodiment of the invention.

As shown in the perspective view of FIG. 1, a flag pin 10 is provided in accordance with certain aspects of an embodiment of the invention. Flag pin 10 has a straight pin 20 having a sharpened tip 22 at the bottom end of straight pin 20, and may be comprised of steel or other metal so as to form an elongate shaft. Optionally, a pin head 24 may be provided at the top end of straight pin 20. Pin head 24 may be a rounded surface mounted to the top of straight pin 20 in any suitable manner, such as a sphere, so as to provide an easy surface against which a user may push to insert the straight pin 20 through a substrate, such as the foam base of a map or other diagram (not shown). Alternatively, pin head 24 may be a flat disc or plate, or any other surface suitable for engagement by a user to allow easy push-insertion of the flag pin into such a base. Further, pin head 24 may be of any color or of multiple colors or may contain varied indicia so as to allow a user to identify differing flag pins 10 on a diagram by the visual characteristics of pin head 24.

Flag pin 10 also includes a flag 30 attached to and extending outward from the upper end of pin 20. In those configurations in which straight pin 20 is provided a pin head 24 at the top end of pin 20, flag 30 may be attached to pin 20 so that a top edge 32 of flag 30 abuts the bottom of pin head 24, thus maximizing the length of straight pin 20 that extends downward from a bottom edge 34 of flag 30. Flag 30 is preferably mounted to pin 20 so that flag 30 extends outward from a side of pin 20, as opposed to overlapping a portion of pin 20. This results in the pin 20 being visible from all sides other than the single line at which the flag abuts pin 20, in turn giving the appearance of a flag pole. Further, flag 30 may be joined to pin 20 through any suitable attachment mechanism, such as (by way of non-limiting example) providing a piece of clear tape (not shown) that extends from the front surface of flag 30, around pin 20, and onto the back surface of flag 30, in turn allowing easy assembly and thus customization of various flags on flag pin 10 to accommodate a user's particular requirements.

In order to hold flag pin 10 in a vertical position after its placement on a map or other diagram surface, a flag mount (shown generally at 40) is provided. Flag mount 40 includes a cylindrical sleeve 42 and a base 50. As shown in FIG. 1, cylindrical sleeve 42 extends upward from base 50, with pin 20 extending downward through sleeve 42 and through base 50 so that when flag pin is positioned on a map or other diagram surface, sleeve 42 and base 50 will hold pin 20, and thus flag pin 10, in an upright and generally vertical orientation.

Figure 2:
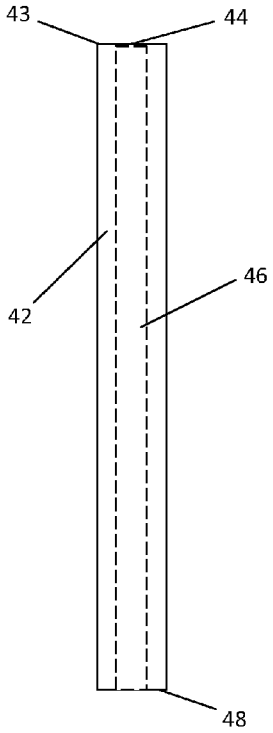
FIG. 2 is a side view of a cylindrical sleeve for use with the flag pin of FIG. 1.

To accomplish this goal of holding flag pin 10 in an upright and generally vertical orientation, sleeve 42 (as shown in FIGS. 1 and 2) has an opening 44 at its top face 43, which opening 44 provides access to a channel 46 that extends centrally through the entire length of sleeve 42, from top face 43 down to the bottom face 48 of sleeve 42. Opening 44 is preferably sized slightly larger than pin 20 so as to allow easy insertion of pin 20 through sleeve 42. While (as discussed in greater detail below) it is base 50 that primarily holds pin 20 in its vertical orientation, sleeve 42 assists in this function by, for instance, preventing the pin 20 from bending or from inadvertently being inserted into base 50 at an angle during assembly and insertion into a map or other diagram base, and likewise prevents excessive bending of flag pin 50 after such insertion if accidentally bumped by a user.

Sleeve 42 is sufficiently rigid (e.g., formed of a rigid plastic) so as to support pin 20 against bending as pin 20 is inserted into a surface on which flag pin 10 is to be used.

Figure 3:
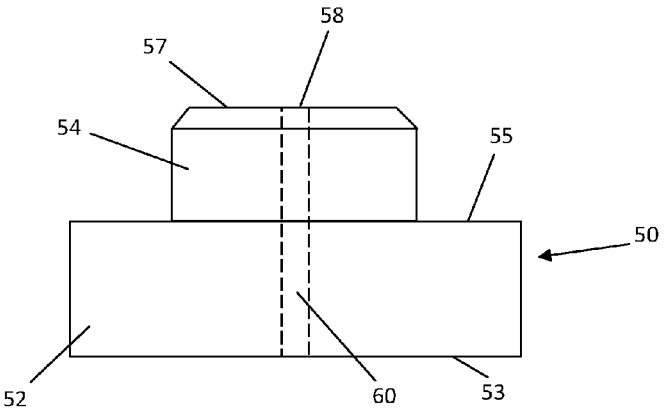
FIG. 3 is a side view of a flexible base for use with the flag pin of FIG. 1.

With continued reference to FIG. 1 and the side view of flexible base 50 of FIG. 3, base 50 includes a lower, generally disc-shaped bottom 52 having a flat bottom face 53. Flat bottom face 53 provides the engaging surface that contacts a map or other diagram surface on which flag pin 10 is to be used. While bottom 52 is shown having a generally circular perimeter, other perimeter configurations, such as square, oblong, or any other shape may be used, so long as they provide a generally flat bottom face for supporting the rest of base 50 (and cylindrical sleeve 42). A sleeve support hub 54 is positioned on the top surface 55 of disc-shaped bottom 52. Support hub 54 has a flat support hub top face 57 which is sized to receive and support the full width of cylindrical sleeve 42. Support hub top face 57 also may have a support hub opening 58 centrally positioned in support hub top face 57, which opening 58 opens into a base channel 60 that extends vertically and centrally through base 50 from the support hub top face 57 through the entire height of support hub 54 and base 50. In such configuration, base channel 60 is sized with a smaller diameter than the exterior diameter of pin 20. As base 50 is formed of a flexible material, such as (by way of non-limiting example) silicone, base channel 60 may compress against a portion of straight pin 20 when the pin 20 is positioned within base 50, serving to both tightly hold pin 20 in an upright position, and to orient pin 20 (and thus flag pin 10) in a vertical orientation. In combination with flat bottom face 53, vertical base channel 60 thus allows multiple flag pins 10 to be placed on a flat surface, such as a flat, horizontal foam map or other diagram surface, while ensuring that the flag pins 10 maintain a vertical orientation. Further, as vertical base channel 60 extends all of the way through base 50, the bottom sharpened tip 22 of pin 20 may be positioned a sufficient distance below flat bottom face 53 to allow the bottom portion of pin 20 to extend into such flat surface on which flag pin 10 is to be placed.

Flexible base 50 preferably has a height dimension of at least 5/16 inches to ensure that base 50 has sufficient surface area to grip and hold pin 20 in a vertical orientation after placement of flag pin 10 on a surface.

Optionally, base 50 may be provided with no channel 60 when originally packaged with sleeve 42. Given the flexible construction of base 50, a user may instead create support hub opening 58 and base channel 60 themselves by pushing straight pin 20 through the center of base 50. Such configuration may provide a tighter hold between base 50 and pin 20, even further assuring that pin 20, and thus flag pin 10, remains in a vertical position without falling during use.

Figure 4:
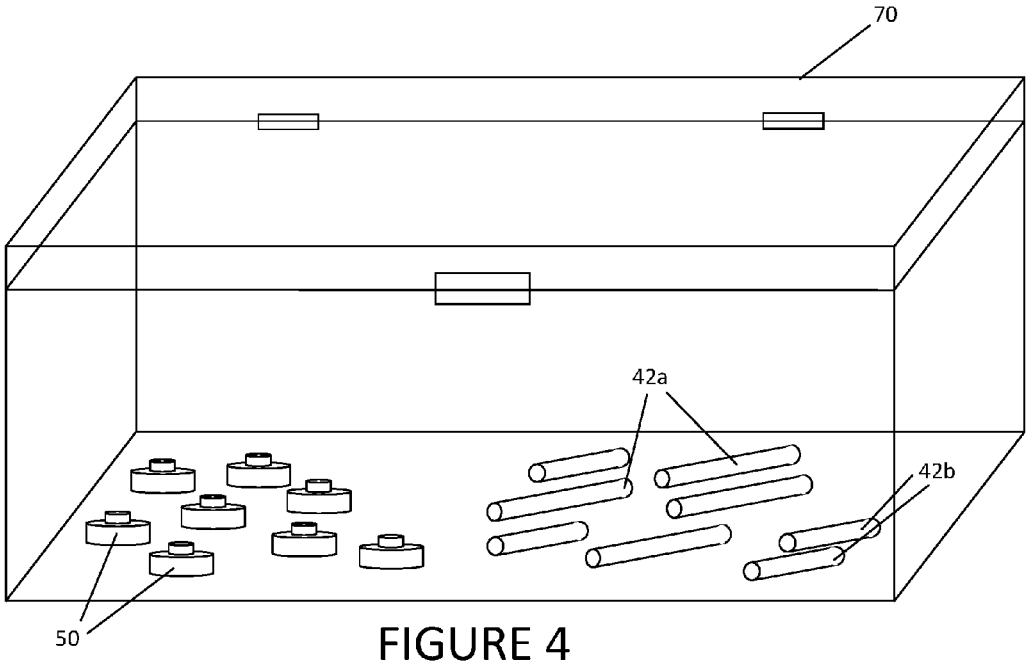
FIG. 4 is a perspective view of a kit for use with the flag pin of FIG. 1.
Figure 5A:
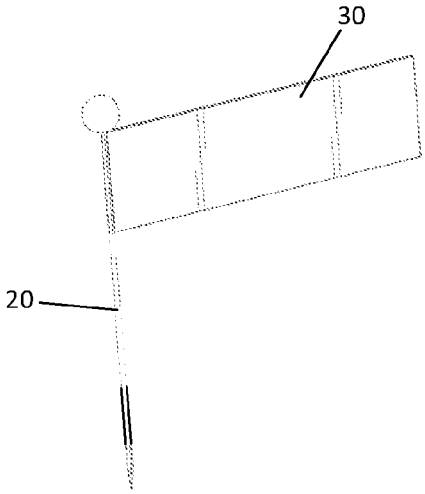
FIGS. 5(*a*) through 5(*d*) show an exemplary method for using the flag pin of FIG. 1.
Figure 5B:
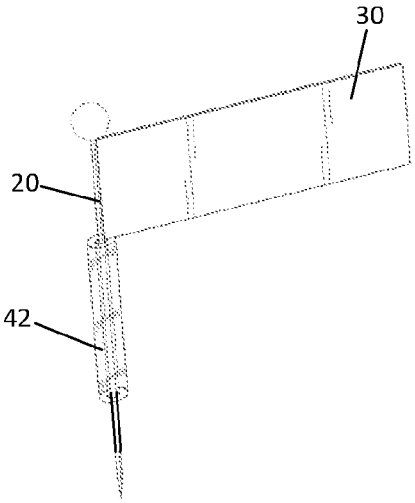
Figure 5C:
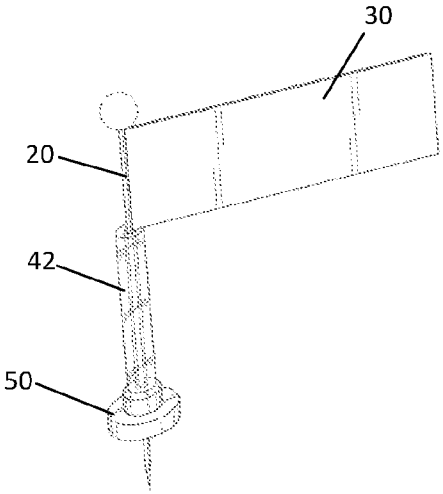
Figure 5D:
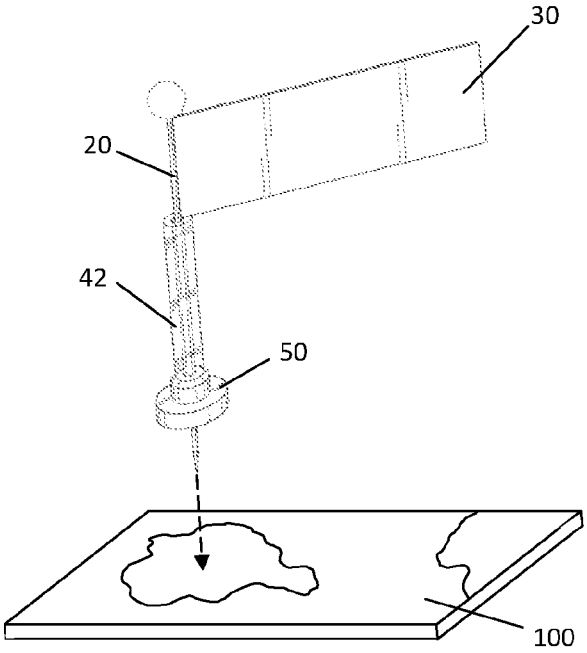

As shown in FIG. 4, a kit 65 may be provided including at least two of the above described elements. More particularly, a kit 65 may include a number of bases 50, each preferably having identical configuration to that described above, along with a number of cylindrical sleeves 42 configured as above. Cylindrical sleeves may optionally be provided in varying lengths, thus providing at least sleeves of a first, longer length 42*a* and sleeves of a second, shorter length 42*b*. Sleeves of varying length 42*a* and 42*b* will enable flags to achieve varying heights when placed on the flat surface on which flag pins 10 are to be used (with sleeve 42 controlling the vertical length of straight pin 20 that will extend above base 50), which may be helpful in situations in which a user wishes for certain of flag pins 10 to be more prominently displayed than other flag pins 10 that are positioned on the same surface. Alternatively, longer spans of cylindrical sleeve 42 may be provided with either weakened sections allowing the user to break sleeve 42 into sections of pre-defined lengths, or with instructions to cut sleeve 42 into appropriate lengths. At least bases 50 and sleeves 42*a* and 42*b* may be provided in a single package 70, such as box having a hinged lid and an easy access snap closure, which constructions are well known in the art and are thus not further described here. Also, while not shown in FIG. 4, kit 65 may optionally also include flags 30 and/or pins 20.

A method of using the foregoing is shown diagrammatically in FIG. 5. As shown at step (a), a pin 20 is provided, and a user may attach a flag 30 to the top of pin 20 so that flag 20 extends outward from a side edge of pin 20. This may be accomplished, by way of non-limiting example, by positioning an edge of flag 30 on a piece of clear tape, positioning such edge of flag 30 adjacent pin 20, and wrapping the tape around pin 20 to adhere to the opposite side of flag 30. Next, at step (b), a cylindrical sleeve 42 may be placed over pin 20 and moved into a position at which an upper edge of cylindrical sleeve 42 abuts a bottom edge of flag 30. Next, at step (c), a flexible base 50 may be placed over pin 20 and moved into a position at which support hub top face 57 of base 50 abuts the bottom face 48 of sleeve 42. Finally, at step (d), the assembled flag pin may be placed on a flat surface 100, such as a foam surface which may optionally include a map or other such diagram design as may be suitable to meet a particular user's requirements.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

What is claimed is:

1. A flag pin comprising:

a straight pin having a top end and a bottom end opposite said top end;

a flag extending outward from said top end of said pin;

a cylindrical sleeve having a channel extending through an entire length of said sleeve, said cylindrical sleeve being positioned below said flag; and a flexible base positioned below said sleeve;

wherein said pin extends through both said cylindrical sleeve and said flexible base, and wherein the bottom end of said pin extends a distance away from a bottom of said flexible base.

2. The flag pin of claim 1, wherein said cylindrical sleeve is removably positioned on said flag pin.

3. The flag pin of claim 2, wherein said cylindrical sleeve has a top end and a bottom end, wherein said top end of said cylindrical sleeve is positioned in contact with a bottom horizontal edge of said flag.

4. The flag pin of claim 2, wherein said flexible base has a top end and a bottom end, wherein said top end of said flexible base is in contact with said bottom end of said cylindrical sleeve.

5. The flag pin of claim 4, wherein said bottom end of said flexible base defines a flat, horizontal surface configured to facially abut a flat surface on which said flag pin is to be placed.

6. The flag pin of claim 4, wherein said flexible base further comprises a disc-shaped bottom and a sleeve support hub extending upward from said disc-shaped bottom and having a smaller diameter than a diameter of said disc-shaped bottom, and a base channel extending centrally and vertically through each of said sleeve support hub and said disc-shaped bottom.

7. The flag pin of claim 6, wherein said flexible base is removably positioned on said flag pin.

8. A method of using a flag pin, comprising:

providing a straight pin having a top end and a bottom end opposite said top end, and a flag extending outward from said top end of said pin;

providing a cylindrical sleeve having a channel extending through an entire length of said sleeve;

providing a flexible base;

positioning said cylindrical sleeve around said pin and below said flag; and positioning said flexible base around said pin and below said cylindrical sleeve, such that said pin extends through both said cylindrical sleeve and said flexible base, and such that the bottom end of said pin extends a distance away from a bottom of said flexible base.

9. The method of claim 8, further comprising forming a channel extending through said flexible base by pushing said bottom end of said pin through said flexible base, and moving said flexible base along said pin so that a top face of said flexible base engages a bottom end of said sleeve.

10. The method of claim 9, wherein said cylindrical sleeve is removably positioned on said flag pin.

11. The method of claim 10, wherein said cylindrical sleeve has a top end and a bottom end, wherein said top end of said cylindrical sleeve is positioned in contact with a bottom horizontal edge of said flag.

12. The method of claim 10, wherein said bottom end of said flexible base defines a flat, horizontal surface configured to facially abut a flat surface on which said flag pin is to be placed.

13. The method of claim 10, wherein said flexible base further comprises a disc-shaped bottom and a sleeve support hub extending upward from said disc-shaped bottom and having a smaller diameter than a diameter of said disc-shaped bottom, and wherein said channel extends centrally and vertically through each of said sleeve support hub and said disc-shaped bottom.

14. A flag pin kit, comprising:

a plurality of straight pins, each having a top end and a bottom end opposite said top end;

a flag extending outward from each top end of each of said pins;

a plurality of cylindrical sleeves, each having a channel extending through an entire length of said sleeve sized to receive one of said pins therethrough;

a plurality of flexible bases configured for placement on each of said pins adjacent to one of said sleeves;

wherein each of said flags, said sleeves, and said flexible bases are sized with respect to said pins so that any one of said pins will extend through any one of said cylindrical sleeves and any one of said flexible bases so that a bottom end of said one of said pins will extend a distance away from a bottom of said one of said flexible bases when said one of said cylindrical sleeves and said one of said flexible bases is positioned on said one of said pins.

15. The flag pin kit of claim 14, wherein said cylindrical sleeves are provided in varying lengths.

16. The flag pin kit of claim 14, wherein a bottom end of each said flexible base defines a flat, horizontal surface configured to facially abut a flat surface on which an assembled flag pin is to be placed.

17. The flag pin kit of claim 14, wherein each said flexible base further comprises a disc-shaped bottom and a sleeve support hub extending upward from said disc-shaped bottom and having a smaller diameter than a diameter of said disc-shaped bottom.

* * * * *